US006669061B2

(12) United States Patent
Tada

(10) Patent No.: US 6,669,061 B2
(45) Date of Patent: Dec. 30, 2003

(54) PUMP DISPENSER AND SPRAYING APPARATUS

(75) Inventor: Tetsuya Tada, Tokyo (JP)

(73) Assignee: Canyon Co., Ltd., Tokyo (JP)

( * ) Notice: Subject to any disclaimer, the term of this patent is extended or adjusted under 35 U.S.C. 154(b) by 102 days.

(21) Appl. No.: 10/008,685

(22) Filed: Dec. 7, 2001

(65) Prior Publication Data

US 2003/0024951 A1 Feb. 6, 2003

(30) Foreign Application Priority Data

Jul. 31, 2001 (JP) ..... 2001-232248

(51) Int. Cl.[7] ..... B67D 5/40

(52) U.S. Cl. ..... 222/383.1; 222/380; 222/153.13; 239/321

(58) Field of Search ..... 222/383.1, 380, 222/385, 321.1, 321.2, 321.7, 321.9, 153.01, 119.06, 153.03, 153.13, 481.5, 541.9; 239/333, 354, 577, 368, 369

(56) References Cited

U.S. PATENT DOCUMENTS 3,913,841 A * 10/1975 Tada ..... 239/321
4,230,277 A * 10/1980 Tada ..... 239/333
4,350,298 A * 9/1982 Tada ..... 239/333
4,558,821 A * 12/1985 Tada et al. ..... 239/333
4,815,663 A * 3/1989 Tada ..... 239/333
4,944,431 A * 7/1990 Blake ..... 222/276
4,958,754 A * 9/1990 Dennis ..... 222/383.1
5,590,834 A * 1/1997 Foster ..... 239/333
5,609,299 A * 3/1997 Foster et al. ..... 239/304
6,036,112 A * 3/2000 Hunsicker ..... 239/333
D471,812 S * 3/2003 Tada ..... D9/448

* cited by examiner

*Primary Examiner*—Gene Mancene
*Assistant Examiner*—Frederick C. Nicolas
(74) *Attorney, Agent, or Firm*—Flynn, Thiel, Boutell & Tanis, P.C.

(57) ABSTRACT

A pump dispenser which precisely transmits trigger motion and enables stable operation of a piston section. The manually operable pump dispenser is mounted on a vessel wherein the liquid contained in the cylinder section is compressed with a piston section by the displacement of a trigger structure and is ejected through a nozzle orifice. The dispenser includes a base body fixed on the vessel orifice via a packing structure, a cylinder section and a vent cylinder section formed adjacent to each other on the base body, and a trigger structure including a trigger section, a valve casing section mounted on the base body, and a trigger guide section oscillating in the vent cylinder section.

25 Claims, 15 Drawing Sheets

PUMP DISPENSER AND SPRAYING APPARATUS

BACKGROUND OF THE INVENTION

1. Field of the Invention

This invention relates to a pump dispenser, and in particular to a manually operated pump dispenser wherein the liquid contained in a cylinder is compressed by the displacement of a trigger structure so that the liquid may be ejected from the nozzle orifice. The invention also relates to a spraying apparatus provided with such a pump dispenser.

2. Description of Related Art

Traditionally, manually operated pump dispensers mounted on a vessel have been used for ejecting liquid.

FIGS. 17 and 18 show examples of the parallel displacement model of this type of pump dispenser, and are respectively a schematic illustration showing how it is used and an expanded sectional view showing specifically its construction.

This pump dispenser 100 is mounted on a liquid vessel B, and the liquid sucked from the vessel B and contained in the cylinder 101 is compressed with a piston 103 by the displacement of the trigger 102 and is ejected from the nozzle 104.

The trigger 102 in this case is on the prolongation of the piston 103 and displaces in parallel, in other words it has a parallel displacement-type construction.

Unlike rotary trigger spraying apparatus, it has no winged protruding trigger and is relatively compact.

In actual use, as shown in FIG. 17 the user operates it by opening the fingers, for example, the index finger and the middle finger and holding the trigger 102 with them.

And by applying force on the fingers holding the trigger and pulling the trigger towards the cylinder 101, the liquid contained in the cylinder 101 is compressed and is ejected from the nozzle 104.

However, the operation of opening the fingers as mentioned above in the traditional examples, holding the trigger 102 with them and pulling the trigger 102 towards the cylinder 101 is different from the usual way of using fingers. Therefore, the operation is complicated and not so easy to perform.

And for example while the index finger and the middle finger are opened and hold the trigger 102, on the other side the inner lower surface of the thumb will be in contact with the back side of the pump dispenser, and when the trigger is pulled with force, the fingers will be in an unnatural state.

Moreover, as shown in FIG. 17 or FIG. 18, the nozzle 104 is arranged at the end of a straight line from the cylinder 101, and therefore in the event of a leakage, due to the position of the nozzle 104 between the fingers, the fingers tend to become soiled with the liquid.

And when the liquid is ejected downward, the whole liquid vessel integrated with the pump dispenser 100 must be inclined for use so that the nozzle 104 may face downward. Thus, a momentum results from the weight of the liquid vessel and burdens the operating hands.

And when the pump-dispenser is used in such an inclined position, if the cap 105 is not closed tightly enough, the liquid may leak from the gap between the cap 105 and the orifice of the vessel B.

On the other hand, in case of a pump dispenser with a rotary trigger not shown, as a trigger based on rotary motion is operated to start a linear motion of the piston, the piston and the trigger are connected by a free motion hole.

Accordingly, the transmission of power from the trigger to the piston is not necessarily precisely assured, and the oscillating motion of the piston in relation to the cylinder often becomes unstable.

And the trigger, the valve case, etc. are independent, resulting in a large number of components as a whole.

SUMMARY OF THE INVENTION

This invention was made under such a technical background.

It is therefore an object of this invention to provide a pump dispenser that gives a precise trigger motion to the piston and enables stable motion of the piston.

It is another object of this invention to provide a manually operated pump dispenser that can prevent careless operation of the trigger.

Another object of this invention is to provide a spraying apparatus provided with such a pump dispenser.

Thus, as the result of their devoted and intensive research carried out under such a background, the inventors of this invention found that the various problems mentioned above can be solved by integrating the valve casing (the second valve casing), the trigger section and the trigger guide section into a single trigger structure, and completed this invention based upon this finding.

This invention relates to (1) a manually operated pump dispenser mounted on a vessel wherein liquid contained in the cylinder section is compressed with a piston section by the displacement of a trigger structure and is ejected through the nozzle orifice, and includes a base body fixed on a vessel orifice via a packing structure including a cylinder section and a vent cylinder section formed adjacent to each other on the base body, the trigger structure including a trigger section, a second valve casing section mounted on the base body, and a trigger guide section oscillating in the vent cylinder section.

This invention also relates to (2) a pump dispenser wherein the nozzle cover is integrated with the second valve casing section via a hinge section.

This invention also relates to (3) a pump dispenser wherein the nozzle cover includes a protrusion designed to block the nozzle orifice.

This invention also relates to (4) a pump dispenser wherein the nozzle cover includes a mesh section for foaming and a nozzle stopper is provided between the nozzle cover and the nozzle orifice for closing the nozzle orifice.

This invention also relates to (5) a pump dispenser wherein the second valve casing section includes an anti-falling section relative to the base body.

This invention also relates to (6) a pump dispenser wherein the second valve casing includes an inside boss section and an outside boss section between which the cylinder section oscillates.

This invention also relates to (7) a pump dispenser wherein the outside boss section of the second valve casing forming a nozzle cover is formed with a downwardly slanting extension.

This invention also relates to (8) a pump dispenser wherein a virgin seal for preventing the pull back of the trigger structure is integrated with the vent cylinder section of the base body.

This invention also relates to (9) a pump dispenser wherein a trigger lock section for preventing the pull back of the trigger structure is integrated with the base body via a hinge section, and the trigger lock section is formed so as to be in contact with the final end of the outside boss section of the second valve casing section.

This invention also relates to (10) a pump dispenser wherein an inside virgin seal is provided at the final end of a cylindrical body of the piston section and a protruding shaft is provided in a cylinder receptacle section formed at the deepest end of the cylinder section.

This invention also relates to (11) a pump dispenser wherein a first valve casing section and a packing are integrated with each other to form the packing structure.

This invention also relates to (12) a pump dispenser wherein the packing structure is integrated with a tubular body.

This invention also relates to (13) a manually operated trigger-type pump dispenser mounted on a vessel wherein liquid contained in the cylinder is compressed via a piston section by the displacement of a trigger structure and is ejected through a nozzle orifice, including a base body fixed on the vessel orifice via a packing structure, a cylinder section and a vent cylinder section formed adjacent to each other on the base body, the trigger structure including a trigger section, a second valve casing section mounted on the base body, and a trigger guide section oscillating in the vent cylinder section, a nozzle cover integrated with the second valve casing section via a hinge section and a protrusion for plugging the nozzle orifice at the top of the second valve casing section formed by the nozzle cover, the second valve casing section being provided with an outside boss section and an inside boss section between which a cylinder section can oscillate, a virgin seal section for preventing the pull back of the trigger structure integrated with the vent cylinder section of the base body, a first valve casing section and a packing integrated with each other to form the packing structure, and an anti-falling section relative to the base body formed in the second valve casing section.

This invention also relates to (14) a spraying apparatus provided with the pump dispenser according to either one of (1) to (13) given above.

This invention can be constituted by combining any two or more from (1) to (13) given above provided that they are in harmony with this objective.

The pump dispenser according to this invention can transmit precisely the motion of the trigger structure to the piston and enables the piston to operate stably.

As described above, the pump dispensers according to this invention are assured of a superb operability and smooth and precise operation, are easy to use and enjoy a high reliability as products.

They transmit precisely the motion of the trigger section to the piston, and enable a stable operation of the piston.

The second valve casing of the trigger structure which includes an inside boss section and an outside boss section provides the piston section with an excellent stability of oscillation in relation to the cylinder section.

Similarly, the trigger structure which integrates the trigger section, the second valve casing and the trigger guide provides the piston with an excellent stability of oscillation.

And an anti-falling device is provided between the trigger structure and the base body to prevent any possible unexpected detachment or falling of the trigger structure from the base body.

The provision of a nozzle cover enables the user to easily block or open the nozzle orifice.

Because the trigger structure serves concurrently as the trigger section and the second valve casing section, and also because the first valve casing section and the packing are integral, the whole pump dispenser consists of a limited number of components, and therefore the number of assembly work steps is reduced.

The provision of the virgin seal section, the trigger lock section and the inside virgin seal prevents the possibility of the trigger structure being drawn in and thus assures safety in operation.

As the trigger structure is positioned in the same direction as the displacement direction of the piston section, no lag develops between them.

BRIEF DESCRIPTION OF THE DRAWINGS

FIG. 10(A) is a partial cross-sectional view and FIG. 10(B) is an end view of the virgin seal as seen from the side of the protruding shaft.

DESCRIPTION OF THE PREFERRED EMBODIMENTS

With reference to FIGS. 1–16, the preferred embodiments of the pump dispenser according to this invention will be described.

Figure 1B:
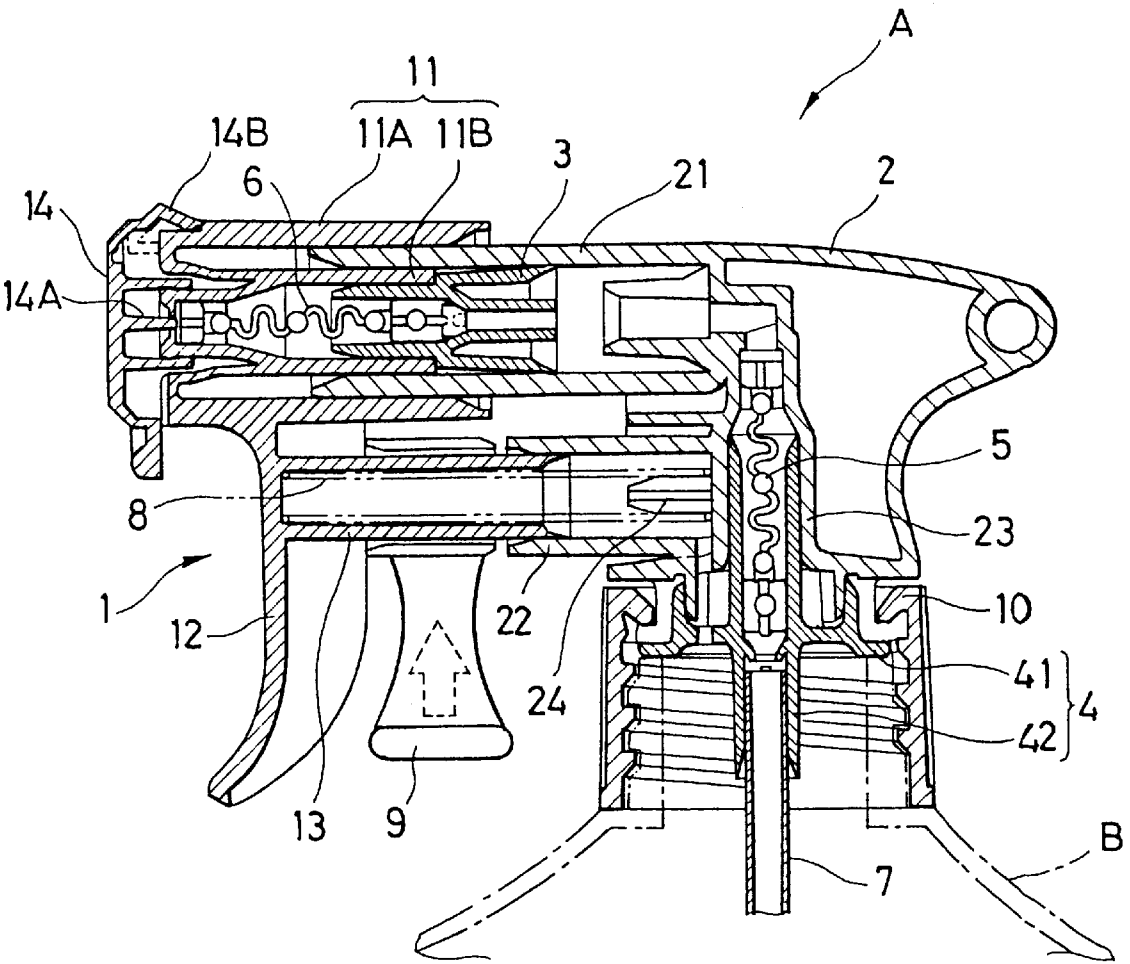
FIG. 1(A) and FIG. 1(B) show an example of composition of the pump dispenser in a preferred embodiment.
Figure 1A:
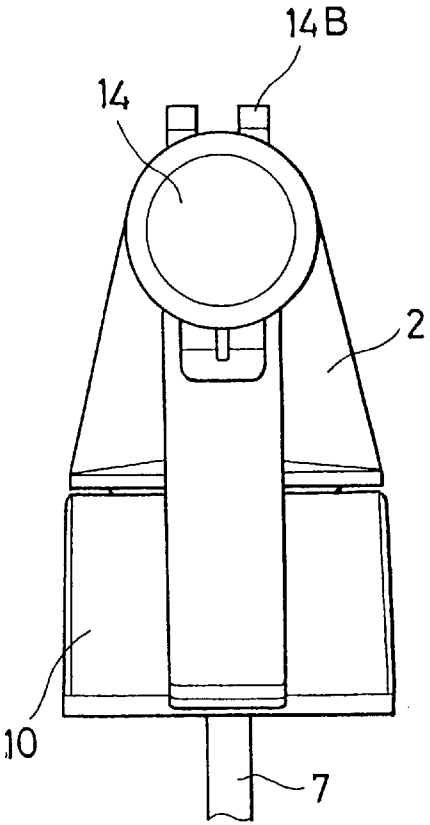

To begin with, FIGS. 1(A) and 1(B) show an example of composition of the pump dispenser A according to this preferred embodiment.

This drawing, however, shows the state of the pump dispenser when the nozzle cover 14 is closed and the virgin seal 9 is not yet separated.

Figure 2B:
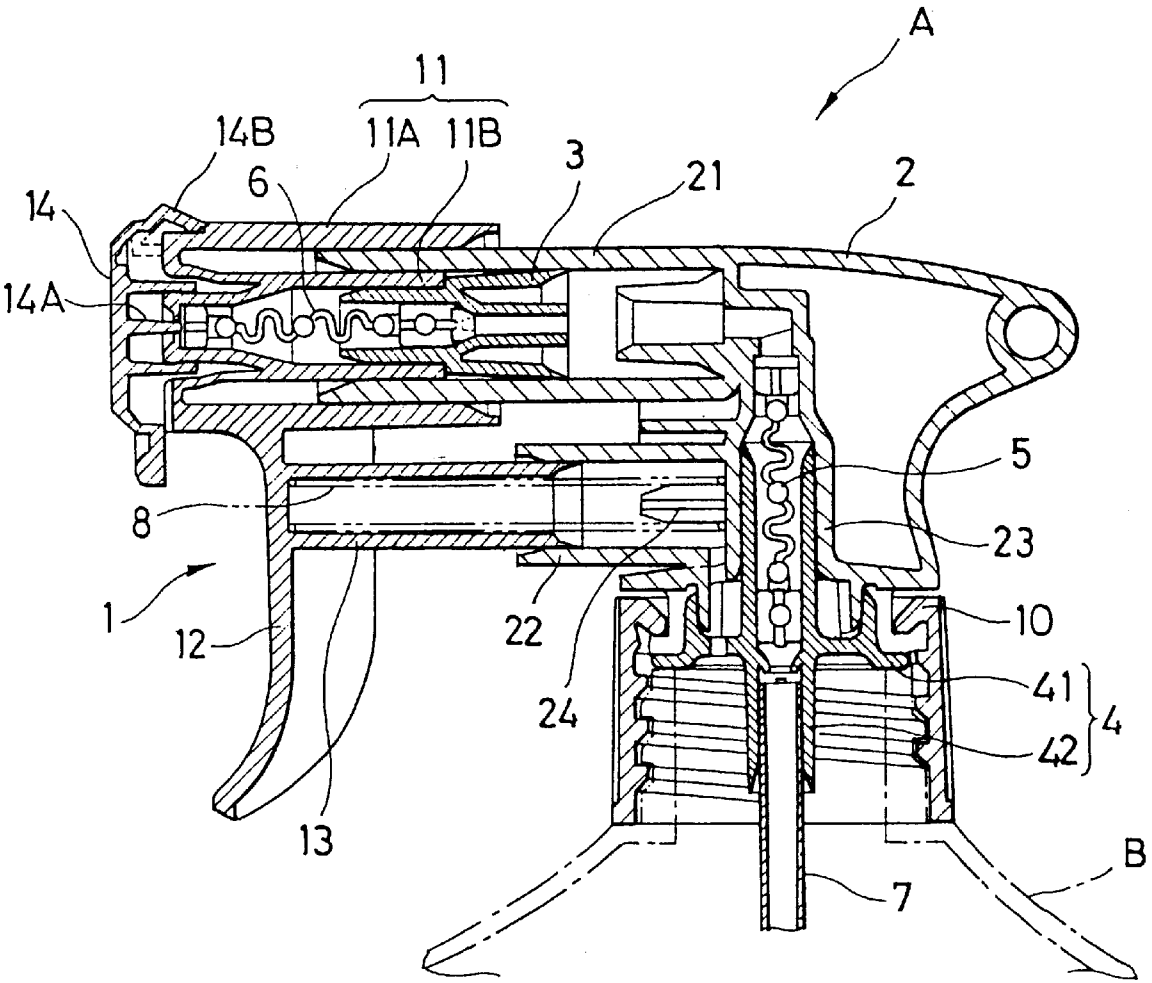
FIG. 2(A) and FIG. 2(B) show the state of the pump dispenser after the virgin seal section is separated from the state of the pump dispenser shown in FIG. 1(B).
Figure 2A:
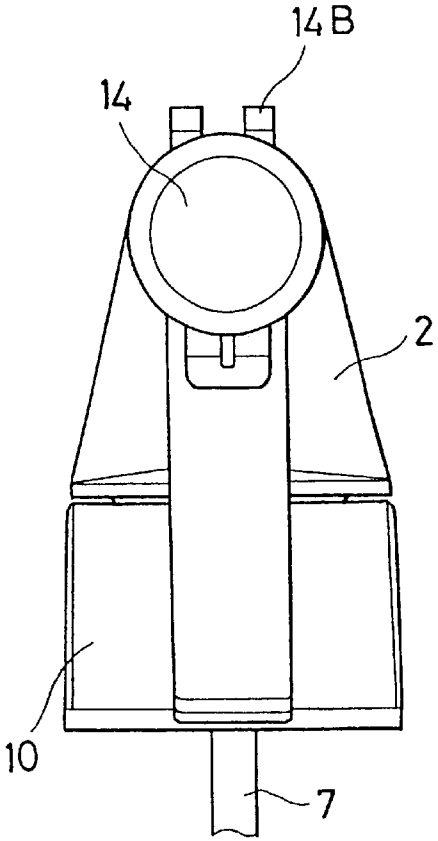

And FIG. 2(B) shows the state the pump dispenser after the virgin seal section 9 is separated from the state of the pump dispenser A shown in FIGS. 1(A) and 1(B).

This pump dispenser A is a manually operated trigger-type pump dispenser as mounted on the vessel B in which the liquid contained in the cylinder 21 is compressed with the piston section 3 by the displacement of the trigger structure and is ejected through the nozzle orifice.

And it includes a trigger structure 1, a base body 2, a piston section 3, a packing structure 4, the first valve 5, the second valve 6, a tubular body 7, a spring body 8, a virgin seal section 9 and a cap 10.

Unlike the traditional rotary trigger, the trigger structure 1 is integrally formed by a trigger section 12 and a second valve casing section 11, and the trigger section 12 is integrated with the trigger guide section 13.

It is preferable that these three components would be integrally formed from polypropylene.

As stated below, the second valve casing section 11 is installed on the base body 2 and the trigger guide section 13 is designed to oscillate within the vent cylinder section 22 of the base body 2.

The piston section 3 is fitted at the top of the second valve casing section 11, and the piston section 3 is arranged so as to be able to oscillate in the cylinder section 21.

The second valve 6 is installed between the second valve casing section 11 and the piston section 3.

And the second valve casing section 11 has a nozzle orifice 11C (see FIGS. 7(A) and 7(B) mentioned below), and it is provided with a nozzle cover 14 to close or open the nozzle orifice 11C.

The nozzle cover 14 is integrated with the second valve casing section 11 via a thin hinge section 14B, and a protrusion 14A is formed therein to plug the nozzle orifice 11C.

Accordingly, the nozzle cover 14 can be swung around the thin hinge section 14B fitting with the second valve casing 11 at one end, and when it is lowered, its protrusion 14A comes into contact with the nozzle orifice 11C and plugs the nozzle orifice 11A, and when it is raised the protrusion 14A separates from the nozzle orifice 11C and opens the nozzle orifice 11C.

The second valve casing section 11 includes an outside boss section 11A of a large diameter and an inside boss section 11B of a smaller diameter, between which the cylinder section 21 of the base body 2 is inserted with pressure, and the second valve casing section 11 is fitted into the base body 2.

In other words, as the trigger structure 1 is pulled badk, the cylinder section 21 oscillates between the outside boss section 11A and the inside boss section 11B of the second valve casing section 11.

Figure 3A:
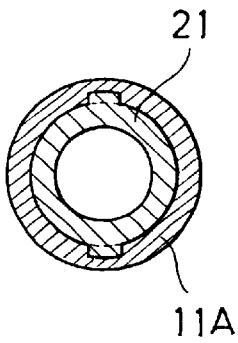
FIG. 3(A) and FIG. 3(B) are sectional views of an anti-fall mechanism provided between the second valve casing section and the cylinder section.
Figure 3B:
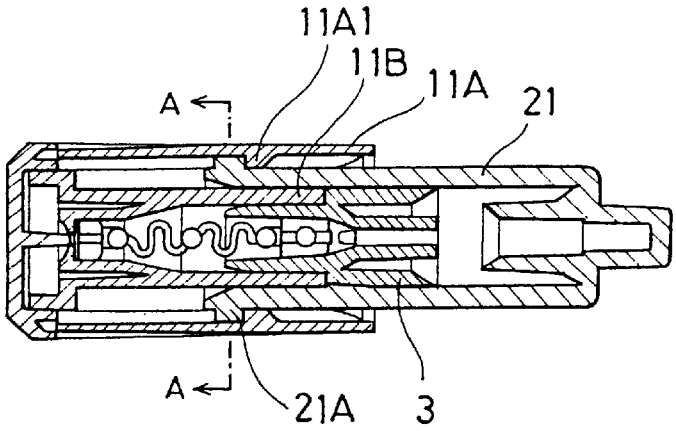

Between the second valve casing section 11 and the cylinder section 21, an anti-fall mechanism is provided as shown in the partial sectional view of FIGS. 3(A) and 3(B).

In other words, in order to prevent any possible falling off of the trigger structure 1 from the base body 2, the outside boss section 11A of the second valve casing section 11 is provided with an anti-fall mechanism.

The anti-fall off section is formed as a protrusion 11A1 which projects inwardly from the outside boss section 11A, and protrusion 11A1 coming into contact with the protrusion 21A on the periphery of the cylinder section 21 will prevent the trigger structure from falling off.

On the other hand, the base body 2 with the trigger structure 1 mounted thereon is fixed on the mouth of the vessel B via the packing structure 4 and forms a holding piece for the trigger section 12 when it is operated with a hand.

For this reason, the base body 2 includes cylinder section 21 for accommodating the piston section 3 and vent cylinder section 22 running parallel thereto for inserting, guiding and letting the trigger guide 13 oscillate.

The base body 2 also includes the proximal section 23 for fixing the first valve casing section 42, and the first valve casing section 42 is inserted into this proximal section 23 and is fixed thereto.

This first valve casing section 42 includes the first valve 5 for opening and shutting the channel for the liquid flowing from the vessel into the cylinder section 21.

In other words, the first valve 5 opens and shuts the channel between the proximal section 23 of the base body 2 and the second valve casing section 11 of another body.

At the bottom of the vent cylinder 22 a cruciform protrusion 24 is provided, and this helps to position a spring 8 outside.

This spring gives return force to the trigger structure 1 when the latter reciprocates.

On the other hand, the virgin seal section 9 provided with a cylindrical section 91 surrounding the trigger guide 13 is integrated with the tip of the vent cylinder section 22 via a thin metal 93.

This virgin seal section is designed to prevent the pull back of the trigger structure 1.

Figure 4A:
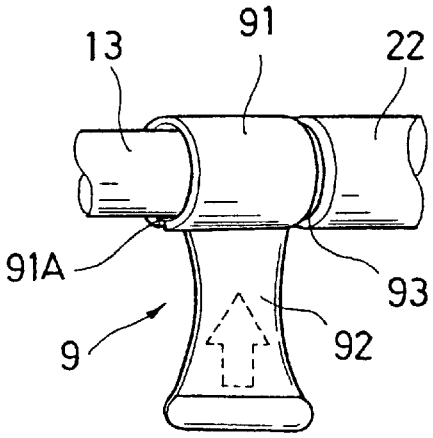
FIG. 4(A) and FIG. 4(B) are enlarged views showing the virgin seal section.
Figure 4B:
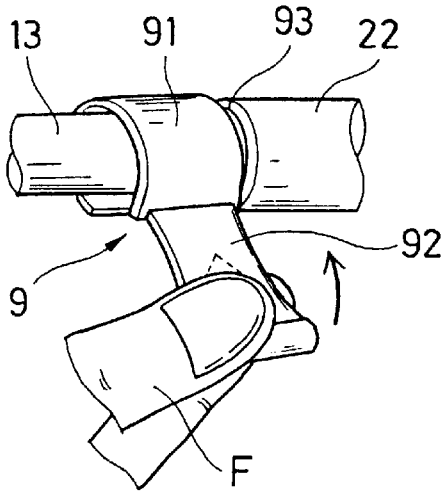

FIGS. 4(A) and 4(B) are enlarged views of a part of the virgin seal section 9.

The cylindrical section 91 of the virgin seal section 9 includes a notch 91A, and by pulling the handle 92, the notch 91A separates and the thin metal 93 is cut out.

Accordingly, as mentioned below, by cutting off the virgin seal 9, it becomes possible to move the trigger structure 1 in relation to the vent cylinder section 22 of the base body 2.

In other words, it becomes possible to pull the trigger section 12 of the trigger structure.

It should be noted in this connection that the handle 92 of the virgin seal section 9 is marked with a pattern showing the direction of the pull, for example an "arrow" as illustrated in the figures.

The first valve casing section 42 and the packing 41 are integrated to constitute the packing structure 4, and thereunder a tubular body 7 constituting the channel sucking liquid from the vessel is fixed.

Figure 5:
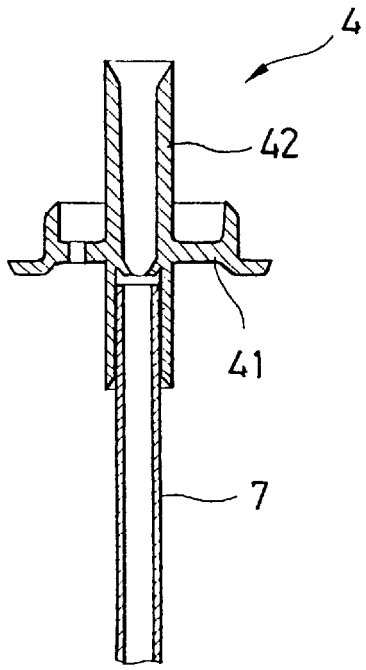
FIG. 5 is a sectional view of the packing structure.

FIG. 5 is an illustration showing the packing structure.

The integration of the first valve casing section 42 and the packing 41 improves the convenience of positioning both of them.

Figure 6:
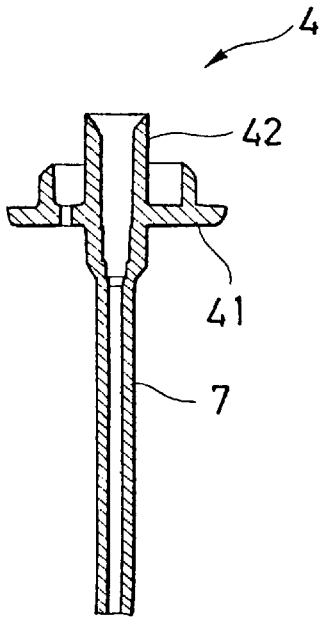
FIG. 6 is a sectional view of another embodiment of the packing structure.

The case wherein the first valve casing section 42, the packing 41 and the tubular body 7 are integrated is illustrated in FIG. 6.

In this case, the long tubular body 7 which is easy to hold improves the efficiency of assembly.

Thus, for the material of the packing structure 4 provided with a packing 41, the adoption of a low density polyethylene (LDPE) is preferable.

The vent cylinder section 22 is designed to guide the trigger structure 1 to be able to displace along its axis in parallel to the cylinder section 21.

The movement of the piston section 3 is very stable because the trigger guide section 13 moves simultaneously along the vent cylinder section 22.

And the piston section 3 integrated with the trigger structure 1 moves in the same direction, and moreover oscillates between the outside boss section 11A and the inside boss section 11B while interpolating the cylinder section 21. Therefore, it operates in a more stable manner.

In addition, the trigger structure 1 includes a notch for venting air (not illustrated) and provided in a part of the trigger guide 13, and regulates the negative pressure in the vessel while the vent cylinder section 22 and the trigger guide section 13 are cut off.

The pump dispenser 4 according to this invention includes as components the trigger structure 1, the base body 2, the piston section 3, the first valve 5, the second valve 6, the packing structure 4 (the first valve casing section 42 and the packing 41 being integrated), and the tubular body 7 totaling seven components altogether. When the tubular body 7 is integrated with the packing structure 4, however, the number of components will be six in total.

As the number of components are fewer than those of the traditional manually operated trigger-type pump dispenser (traditionally, the piston, the trigger and the second valve casing are separate, and the first valve casing and the packing are separate), the number of assembly steps will be fewer and the production efficiency will improve.

As the material of the trigger structure 1, the base body 2, and the cap 10, it is preferable to use polypropylene (PP), and as the material of the valves 5 and 6, the piston section 3 and the packing structure 4, it is preferable to use low density polyethylene (LDPE).

Figure 7B:
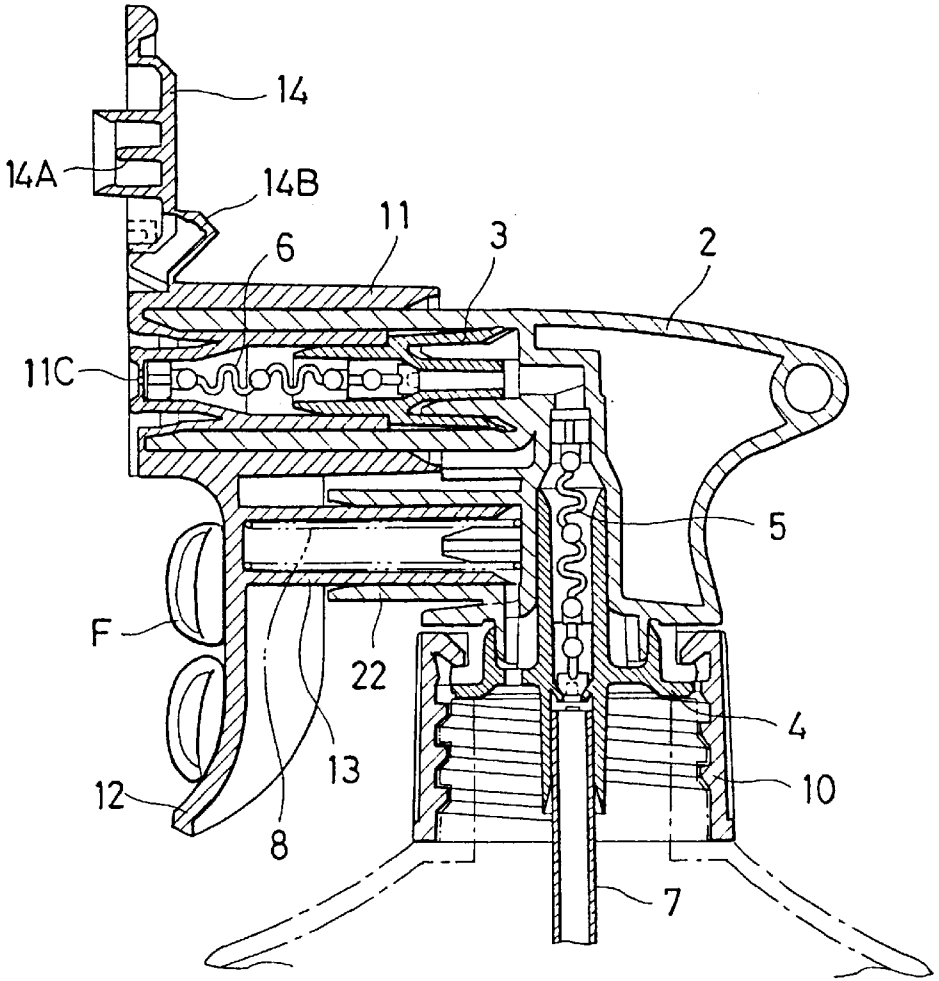
FIG. 7(A) and FIG. 7(B) show the state in actual use of the pump dispenser, and the state when the virgin seal section is removed and the trigger section is pulled.
Figure 7A:
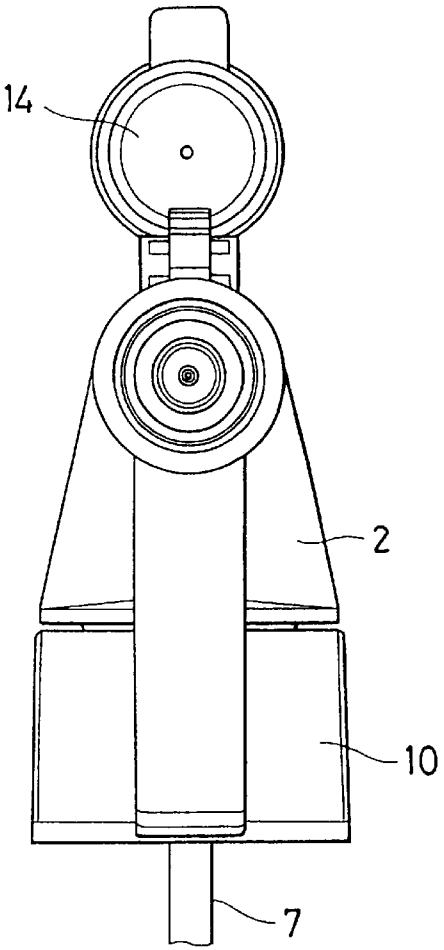

FIGS. 7(A) and 7(B) show the state in use of the pump dispenser A described above when the trigger section is pulled in after removing the virgin seal section.

To operate the trigger section 12, as shown in the figure, two fingers F (for example, the index finger and the middle finger) should be used to hold the trigger section 12 and the bifurcation between the index finger and the thumb (here referred to as "the root of the thumb" for the sake of convenience) should be applied to the area behind the base body 2.

To begin with, a new unused pump dispenser A should be made ready for use.

At first, the virgin seal section 9 should be cut off from the vent cylinder section 22 of the base body 2 by holding the handle 92 of the virgin seal section 9 (see FIG. 4).

Then, the nozzle cover 14 should be swung upward to liberate the nozzle orifice 11C from the plugged state to the open state.

At this point, when short operations of pulling slightly the trigger section 12 of the trigger structure 1 are repeated many times, the liquid contained in the vessel is discharged into the cylinder section 21, and the pump dispenser will be ready for regular use.

Then, the trigger structure 1 should be pulled strongly against the elastic force of the spring 8 while holding the pump dispenser A.

Then, the first valve 5 closes and the second valve 6 opens leading to the ejection of the liquid contained in the cylinder section 21 from the nozzle orifice 11C.

Thereafter, when the trigger structure 1 is liberated, due to the reactionary force of the spring 8, the trigger structure begins to return, and as a result the piston section 3 also starts returning to its original position.

And then, the first valve 5 opens and the second valve 6 closes creating a negative pressure in the cylinder section 21 and causing the liquid contained in the vessel to be sucked.

In the operation described above, by pulling two fingers, the pushing pressure for displacing the trigger structure 1 is dispersed between the trigger guide section 13 and the vent cylinder section 22 as well as between the piston section 3 and the cylinder section 21.

As described above, the action of the spring 8 is supported by the trigger guide section 13 along the vent cylinder section 22 and therefore the motion of the spring 8 becomes very stable.

Moreover, since the trigger structure 1 reciprocates while the cylinder section 21 of the base body 2 is interpolated between the outside boss 11A and the inside boss 11B of the trigger structure 1, a very stable linear displacement motion can be assured.

In addition, due to the provision of an anti-fall off mechanism as mentioned above between the trigger structure 1 and the base body 2, in other words between the cylinder section 21 and the second valve casing section 11, the two components do not inadvertently separate from each other.

On the other hand, as the nozzle orifice 11C can be simply plugged by drawing down the nozzle cover 14, safety is assured.

In the above preferred embodiment, the case wherein the virgin seal section is integrated with the top of the vent cylinder section via a thin metal while enclosing the trigger guide section is described (see FIG. 1(B)).

The reason behind such arrangement is to prevent the pull back of the trigger structure in an unused new pump dispenser A.

Therefore, the virgin seal section need not be at the top of the vent cylinder section and can take another form provided that a similar operational effect can be obtained.

And the virgin seal section is designed for only one-time use. However, instead of cutting off the virgin seal, it is possible to adopt a mechanism of locking the trigger as described below so that it may be used repeatedly.

On the other hand, the measures taken to prevent the pull back of the trigger structure are taken in order to prevent any inadvertent leakage of liquid before the spring apparatus is used. Therefore, by blocking the passage of liquid in the pump dispenser, the leakage of liquid can be prevented with an even greater certainty.

Therefore, with reference to the drawings, the trigger lock section and the virgin seal in the pump dispenser (inside virgin seal) will be described by referring to their respective examples.

Figure 8:
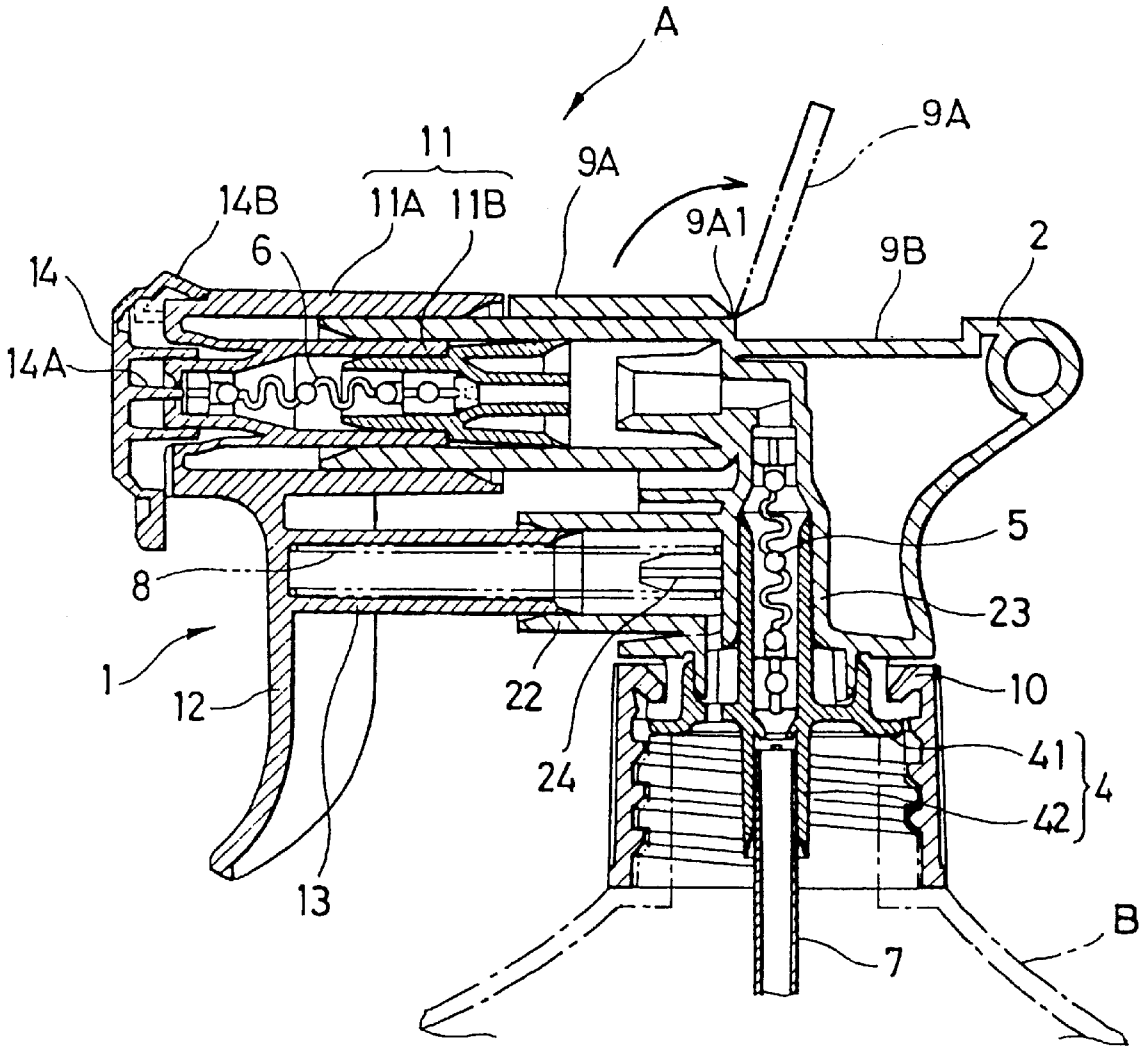
FIG. 8 is a schematic sectional view showing an example of composition of a pump dispenser provided with the trigger lock.

FIG. 8 is a schematic sectional view showing an example of a composition of a pump dispenser provided with a trigger lock section for locking the trigger.

The trigger lock section 9A is integrated with the base body 2 via the hinge section 9A1 and is formed so that it can be swung upwards.

And before the spraying apparatus is put to use, as shown by a solid line, it is formed so that it may touch the rear end of the outside boss section 11A of the second valve casing section 11.

By making such an arrangement, any attempt to pull back the trigger structure before the spraying apparatus is put to use will be blocked by this trigger lock section 9A, and any inadvertent pull back of the trigger structure 1 can be prevented.

And at the beginning of use, as shown in a chain line with two dots, by swinging upward the trigger lock section 9A, the trigger structure 1 will be free of obstacles and can be pulled back freely.

And as shown in the figure once a cavity 9B of a form befitting the trigger lock section 9A that has swung down on the base body 2 is created, the trigger lock section 9A can be accommodated therein, and the trigger lock section 9A will not come in the way when the spraying apparatus is in use.

Incidentally, in this preferred embodiment, any components other than said trigger lock section 9A may be designed in the same way as the preferred embodiment previously maintained.

And now the inside virgin seal will be described.

The inside virgin seal is designed to block the channel of liquid in the pump dispenser as described above. Specifically, when the trigger structure provided with a seal so as to block the channel of liquid is pulled back, the protruding shaft opens the inside virgin seal.

Figure 9:
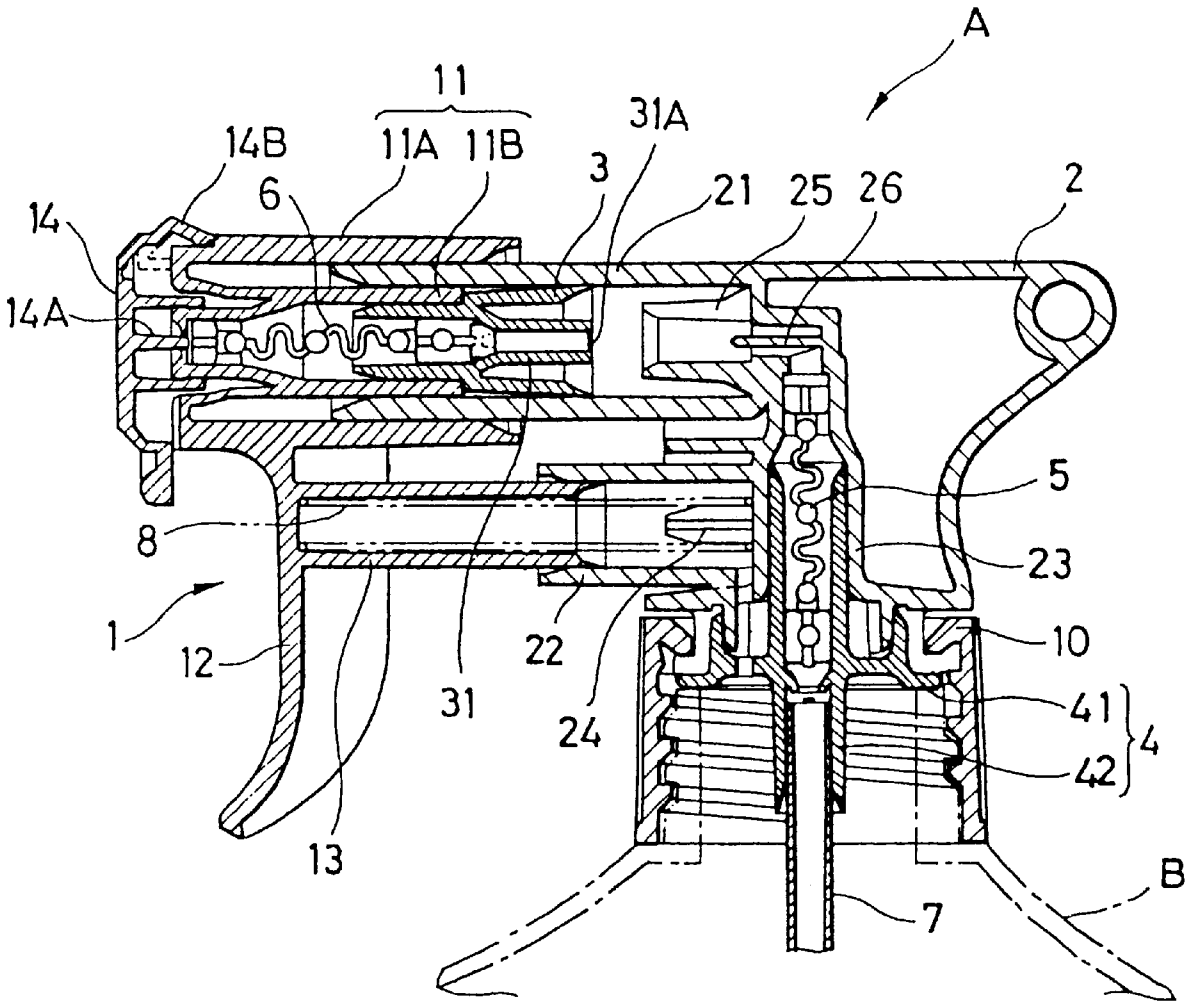
FIG. 9 shows an example of composition of a pump dispenser provided with an inside virgin seal and a protruding shaft.

FIG. 9 shows an example of composition of a pump dispenser provided with an inside virgin seal and a protruding shaft.

The inside virgin seal 31A is formed at the final end of the cylindrical body 31 of the piston section 3, and blocks the opening mouth of the latter before the spraying apparatus is put to use.

And in the cylinder receptacle section 25 provided at the deepest end of the cylinder section 21, a protruding shaft 26 is provided.

Figure 10A:
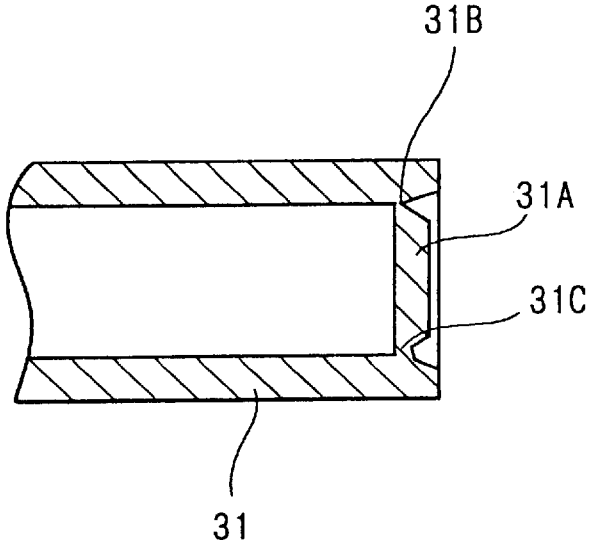
FIG. 10(A) and FIG. 10(B) are enlarged views of the inside virgin seal.
Figure 10:
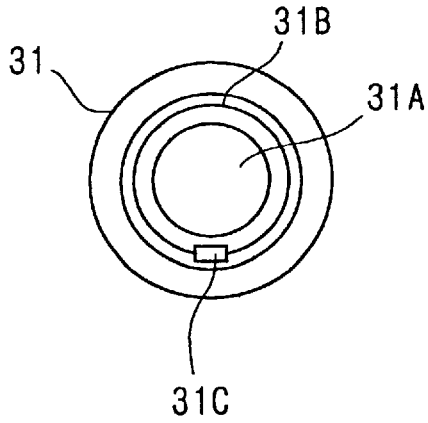

FIGS. 10(A) and 10(B) are enlarged views of the inside virgin seal, and FIG. 10(A) is a partial cross-sectional view and FIG. 10(B) is an end view of the virgin seal from the side of the protruding shaft.

The inside virgin seal 31A is connected with the final end of the cylindrical body 31 via a thin metal 31B surrounding its periphery.

Since this thin metal 31B is weak in terms of physical strength, a thrust of the protruding shaft 26 described below suffices to easily cut off this part.

And since a part of the thin metal section 31B is made thick (hinge section 31C) and this hinge section 31C is strong in terms of physical strength, it is not cut off and can keep the inside virgin seal 31A linked with the cylindrical body 31.

Figure 11:
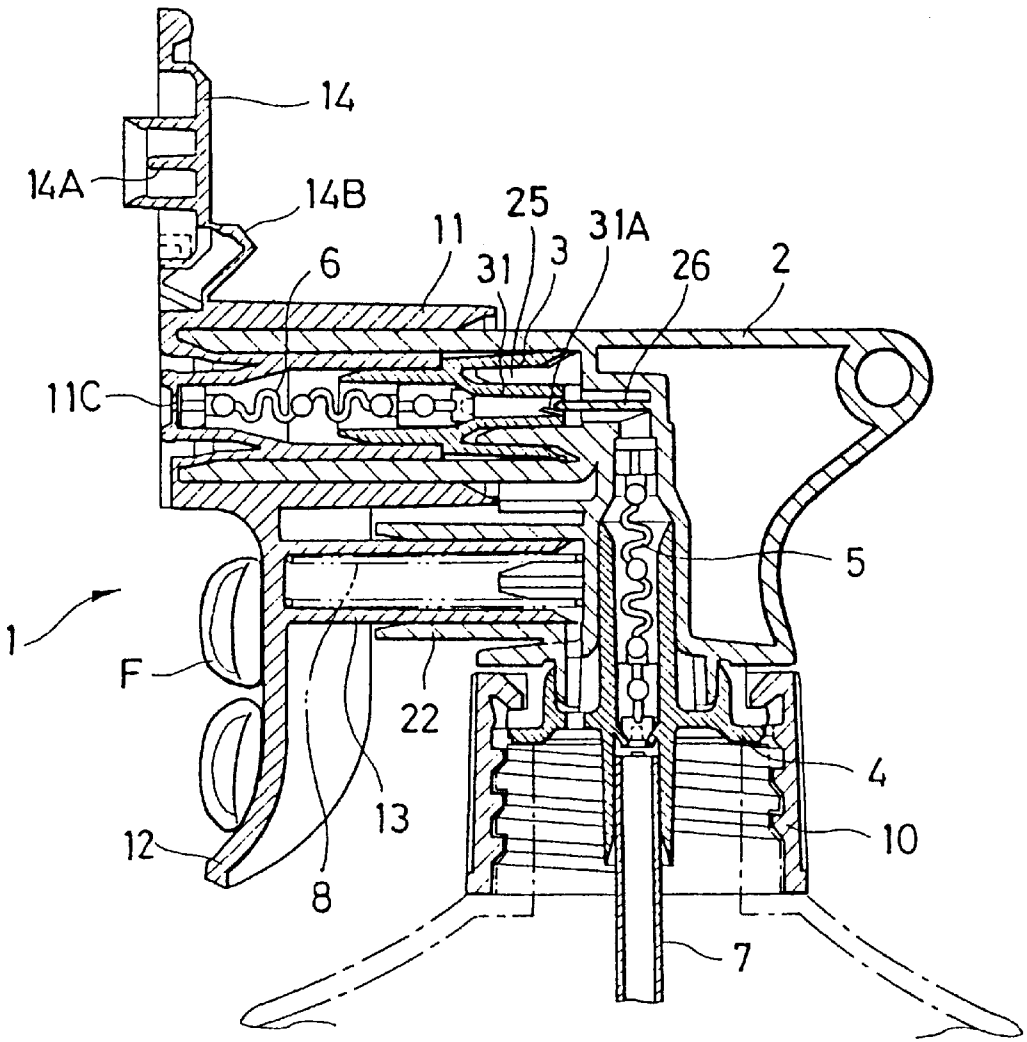
FIG. 11 is a sectional view showing the state of the pump dispenser when the trigger structure is pulled back.

FIG. 11 is a sectional view showing the state of the pump dispenser when the spring apparatus has been put to use and the trigger structure is pulled back.

When the trigger structure 1 is pulled back, the cylindrical body 31 of the piston section 3 is inserted into the cylinder receptacle 25, and in this state a thrust of the protruding shaft 26 causes the inside virgin seal 31A to fall down and opens the mouth.

Figure 12:
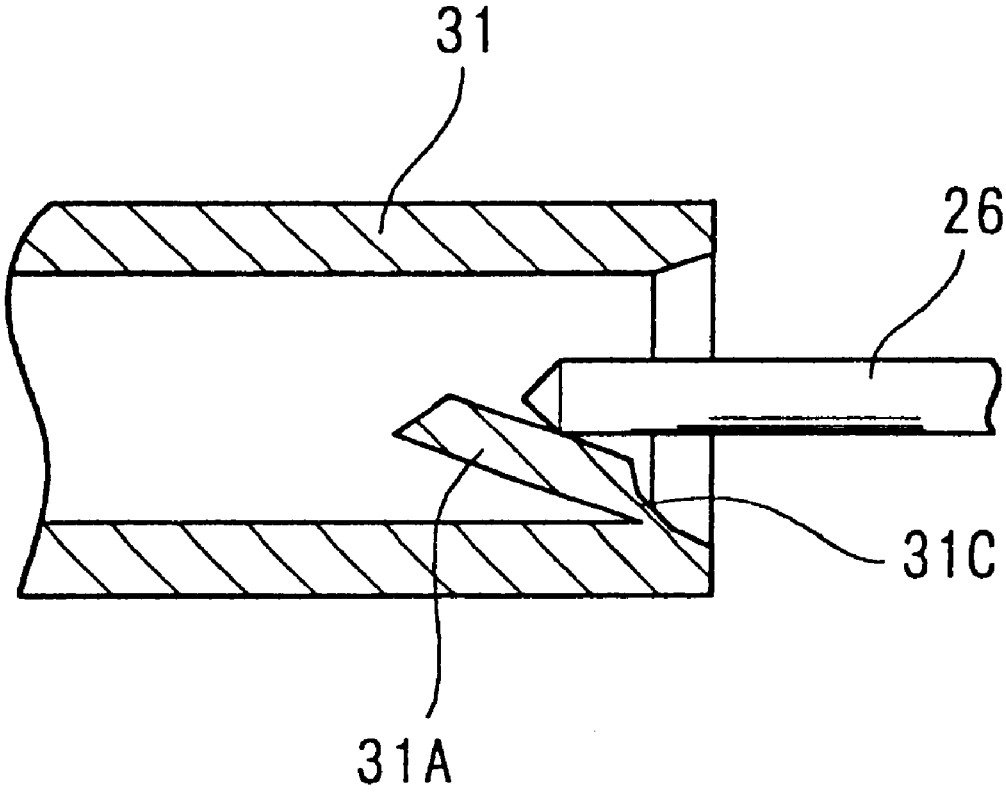
FIG. 12 is an enlarged schematic sectional view showing the inside virgin seal after having been pushed down by a thrust of the protruding shaft.

FIG. 12 is a schematic sectional view showing the inside virgin seal opened by a thrust of the protruding shaft.

The inside virgin seal 31A is placed under pressure from the thrust of the protruding shaft 26 leading to the cutting off of the thin metal part 31B.

However, the hinge section 31C is not broken, and the inside virgin seal 31A swings down around this hinge section 31C and is opened.

If the top end of the protruding shaft 26 is made conical or spherical as shown in the figure, it will facilitate the catching of the seal 31A by the top end and therefore such an arrangement will be preferable.

Figure 13:
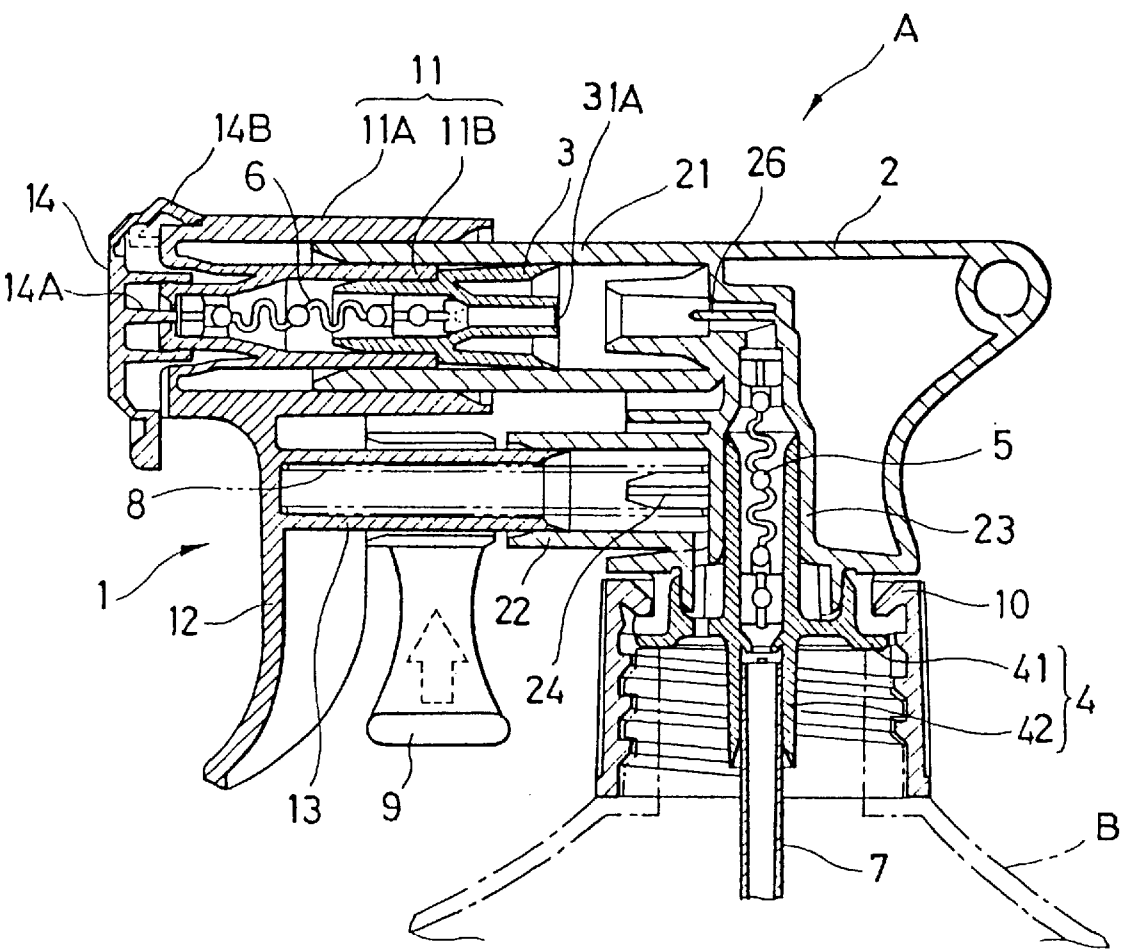
FIG. 13 is a sectional view showing a pump dispenser provided with a virgin seal section and an inside virgin seal.
Figure 14:
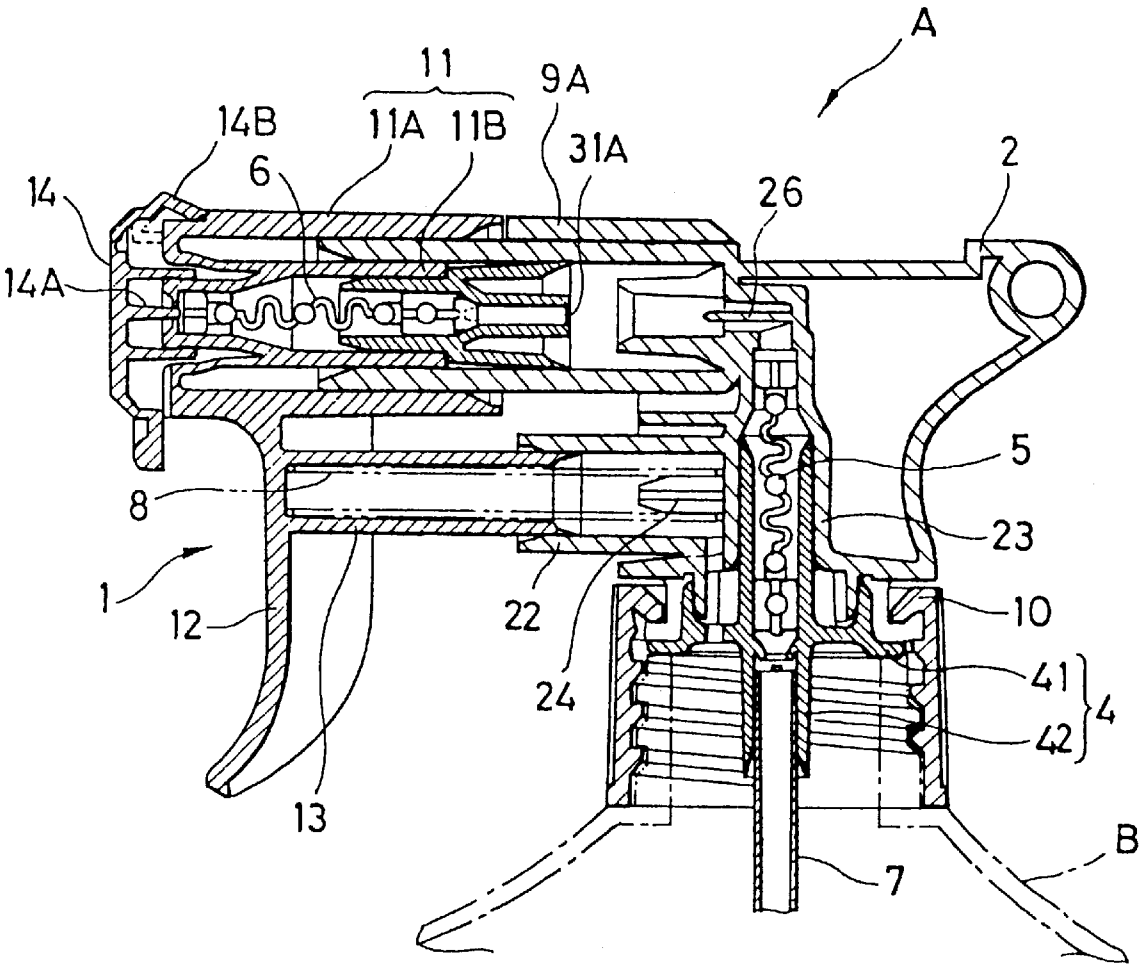
FIG. 14 is a sectional view showing a pump dispenser provided with a trigger lock section and an inside virgin seal.

Now for the reference of the reader, a pump dispenser provided with the virgin seal section 9 and the inside virgin seal shown in the first preferred embodiment will be illustrated in FIG. 13, and a pump dispenser provided with the trigger lock section 9A and the inside virgin seal will be illustrated in FIG. 14.

We have thus far described this invention, but this invention is not limited to said preferred embodiments, and various variations are possible within the limits of this invention.

For example, the form of virgin seal section is not limited to a circular configuration, and variations can be made as necessary.

Also the pump dispenser A may be mounted on many types of vessels.

Figure 15:
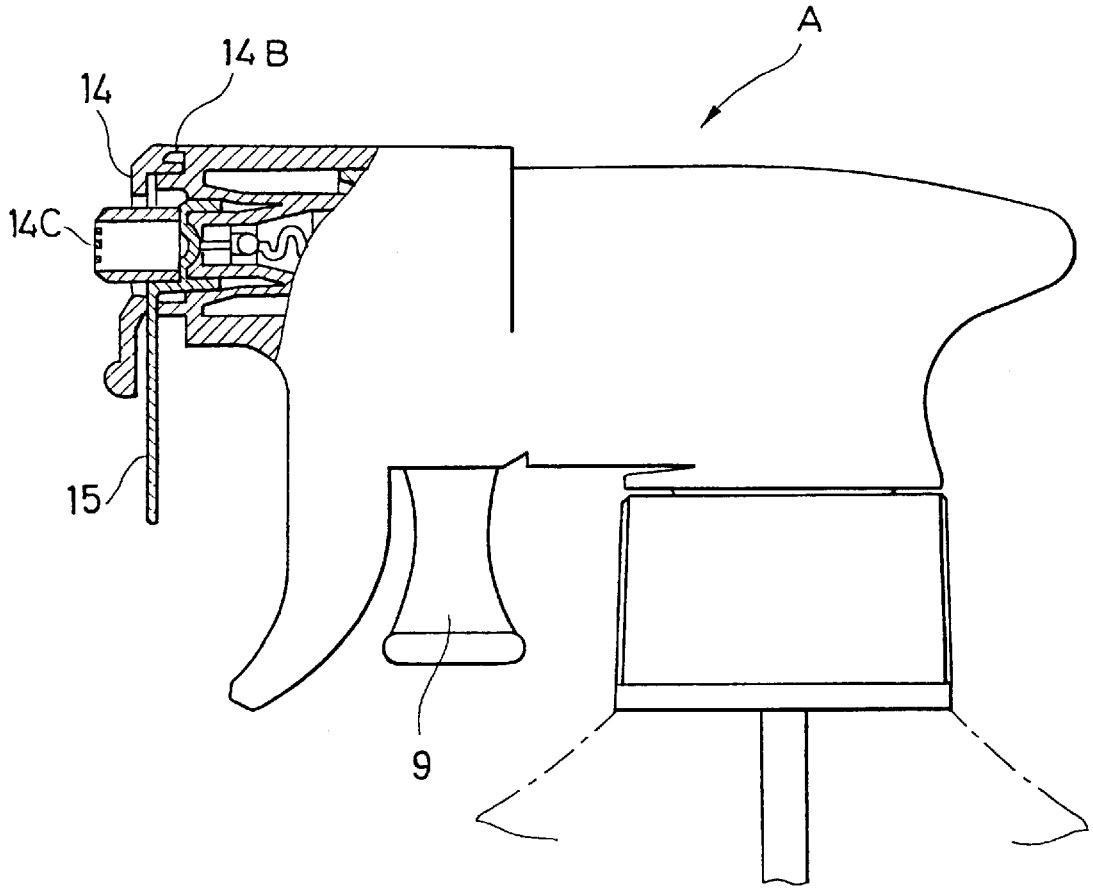
FIG. 15 shows a nozzle cover and a nozzle stopper for foaming.

As shown in FIG. 15, by adopting a nozzle cover 14, it is possible to eject liquid in the form of foam.

To be more specific, by adopting a nozzle cover 14 provided with a mesh section 14C and by letting the liquid ejected from the nozzle orifice pass through the mesh section 14C, the ejection will be foamy.

In this case, it is preferable to provide a nozzle stopper 15 between the nozzle cover 14 and the nozzle orifice for closing the nozzle.

Therefore, when the pump dispenser is put to use, in the first place the nozzle cover 14 is opened, the nozzle stopper 15 is removed, and then the nozzle cover 14 is closed for use.

Figure 16:
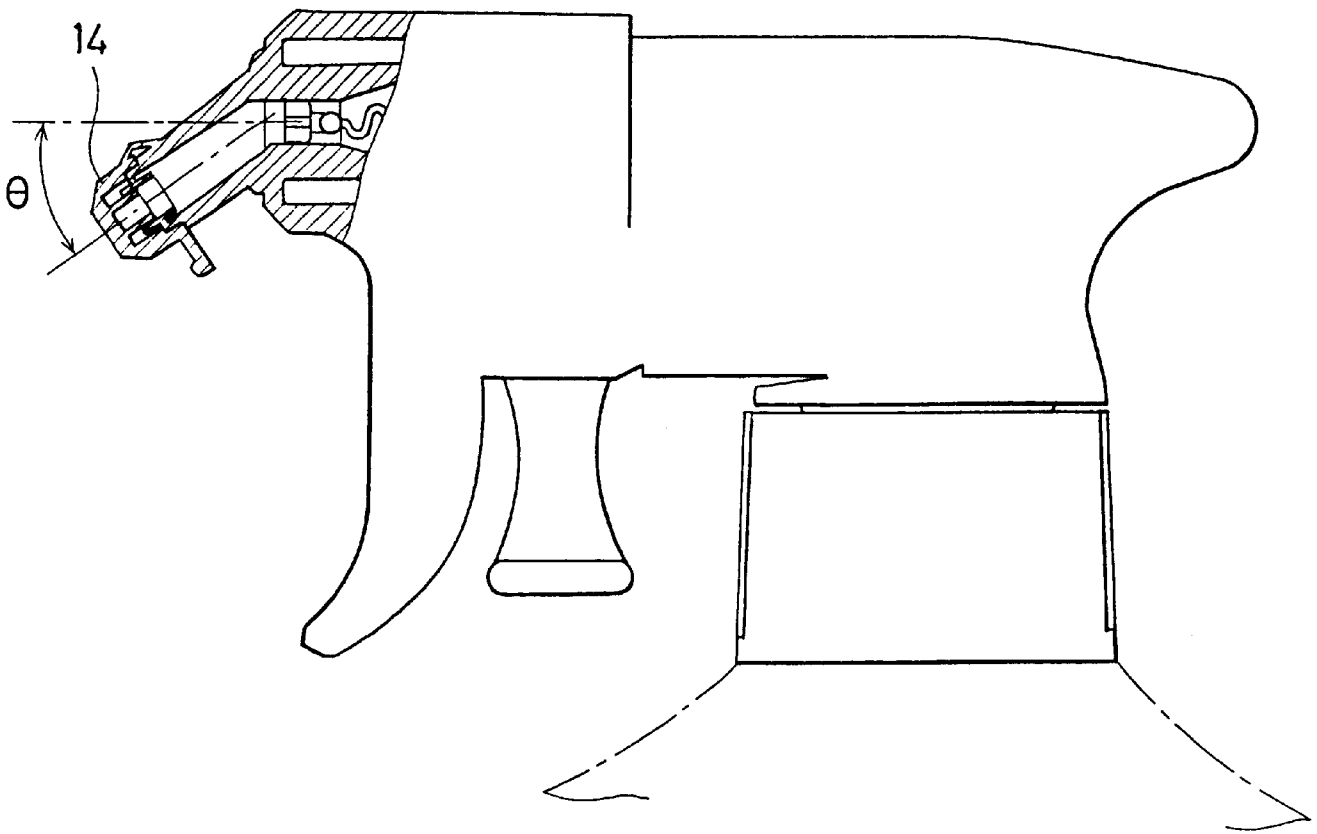
FIG. 16 shows an example of the outside boss section extending in a downwardly sloping manner.
Figure 17:
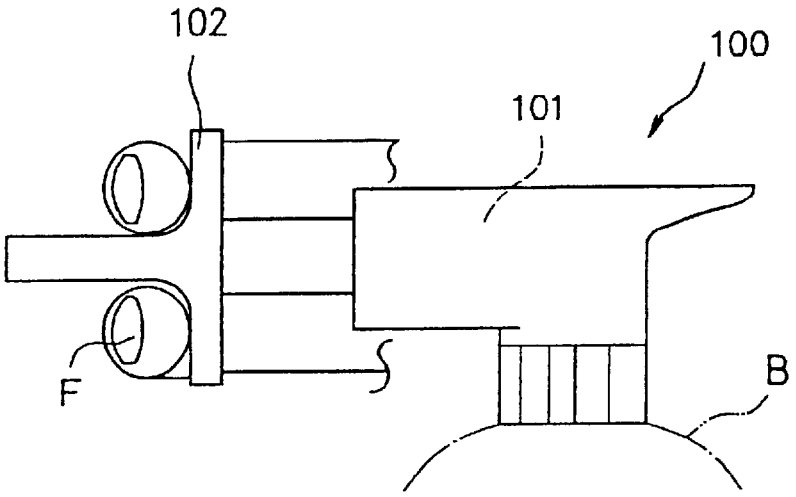
FIG. 17 is a schematic view showing an example of the traditional parallel displacement-type pump dispenser.
Figure 18:
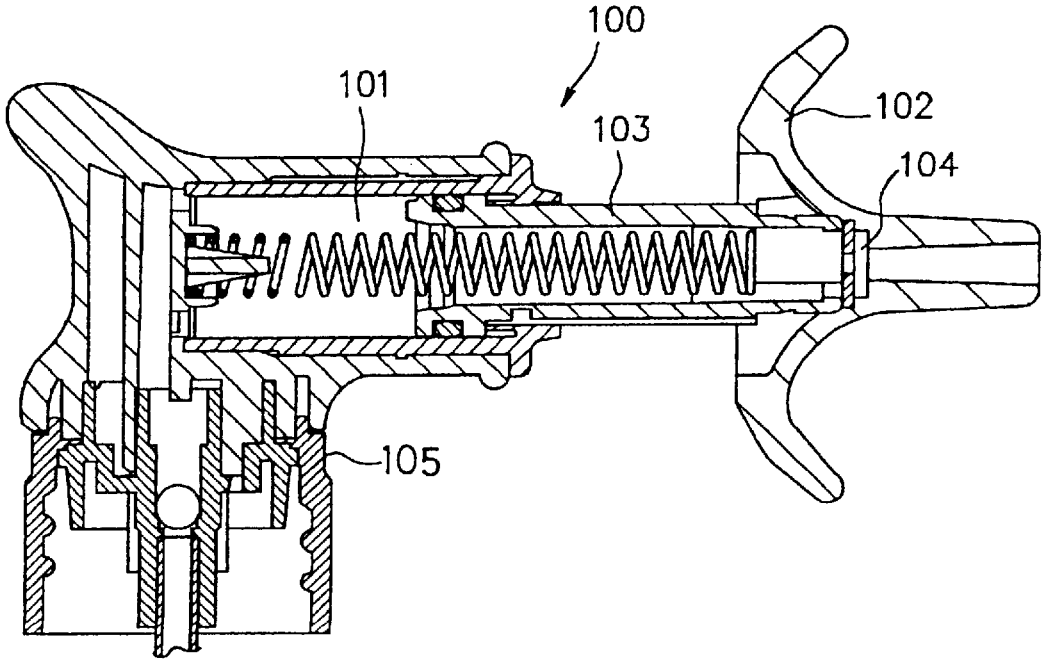
FIG. 18 is a sectional view showing the specific composition of an example of the traditional parallel displacement-type pump dispenser.

And as shown in FIG. 16, the downward sloping extension of the outside boss section 11A of the second valve casing 11 can be integrated with the nozzle cover 14.

Incidentally, in this case, the extension section can be made into a nozzle adapter separate from the second valve casing section 11.

By giving a downward inclination degree of θ, for ejecting the liquid downward there will be no need to incline downward the whole pump dispenser including the vessel (in other words, the whole spraying apparatus).

Since this arrangement avoids the development of momentum due to the weight of the vessel filled with liquid, no material burden is applied on the hands and the pump dispenser made according to this arrangement will be easy to use.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A manually operable pump dispenser for mounting on a vessel wherein liquid contained in a cylinder section is compressed with a piston section through displacement of a trigger structure and is ejected through a nozzle orifice, said dispenser comprising:

a base body for fixing on an orifice of the vessel by a packing structure;

a cylinder section and a vent cylinder section formed adjacent one another on said base body;

a trigger structure including a trigger section, a valve casing section mounted on said base body, and a trigger guide section which oscillates within said vent cylinder section; and a nozzle cover integrated with said valve casing section by a hinge section.

2. The pump dispenser of claim 1 wherein said nozzle cover defines thereon a protrusion configured to block a nozzle orifice defined in said valve casing section.

3. The pump dispenser of claim 2 wherein said nozzle cover is attached to said valve casing by said hinge section, said hinge section permitting swinging movement of said nozzle cover between an open position to allow flow through said nozzle orifice and a closed position wherein said protrusion is aligned with said nozzle orifice to block flow therethrough.

4. The pump dispenser of claim 1 wherein said nozzle cover includes a mesh section disposed over said nozzle orifice to cause foaming of liquid ejected from said nozzle orifice, and said dispenser further includes a nozzle stopper removably disposed between said nozzle cover and said nozzle orifice to block same when said dispenser is not being used.

5. The pump dispenser of claim 1 wherein said valve casing section defines thereon an anti-falling section disposed to prevent detachment of said trigger section from said base body.

6. The pump dispenser of claim 5 wherein said anti-falling section comprises a protrusion which projects radially inwardly from an interior surface of said valve casing section, and said cylinder section includes a protrusion which projects radially outwardly from an exterior surface of said cylinder section and abuts said protrusion of said valve casing section.

7. The pump dispenser of claim 1 wherein said valve casing section defines an outer boss section and an inner boss section oriented generally coaxially with one another and between which an end of said cylinder section is disposed to mount said trigger structure on said base body, said dispenser further including a piston section mounting a valve therein and disposed within said inner boss section, said trigger structure being movable relative to said base body such that said end of said cylinder section oscillates between said outer and inner boss sections during actuation of said trigger section.

8. The pump dispenser of claim 7 wherein said outer boss section is inclined downwardly relative to the horizontal, and said nozzle cover is integrated with said outer boss section.

9. The pump dispenser of claim 1 wherein said valve casing section is a first valve casing section which houses a first valve therein, said dispenser further including a second valve casing section which houses a second valve therein, said packing structure including a packing configured for cooperation with the vessel orifice, said second valve casing section and said packing being integrally formed with one another and together defining said packing structure.

10. The pump dispenser of claim 9 further including an elongate tubular body which extends into the vessel and communicates with said second valve, said tubular body being integrally formed with said packing structure.

11. A spraying apparatus mounting thereon the pump dispenser of claim 1.

12. A manually operable pump dispenser for mounting on a vessel wherein liquid contained in a cylinder section is compressed with a piston section through displacement of a trigger structure and is ejected through a nozzle orifice, said dispenser comprising:

a base body for fixing on an orifice of a vessel;

a cylinder section and a vent cylinder section formed adjacent one another on said base body;

a trigger structure including a trigger section, a first valve casing section mounted on said base body, and a trigger guide section which oscillates within said vent cylinder section, said first valve casing section including an outer boss-shaped section and an inner boss-shaped section between which said cylinder section is disposed;

a nozzle cover integrated with said first valve casing section by a hinge section, said nozzle cover defining a protrusion thereon which is disposed to close off a nozzle orifice defined in said first valve casing section;

a virgin seal section integrated with said vent cylinder section and disposed to prevent actuation of said trigger structure;

a second valve casing section and a packing integrated with one another and together defining a packing structure for fixing said base body on the vessel orifice; and an anti-falling section formed on said first valve casing section to prevent detachment of said trigger structure from said base body.

13. The pump dispenser of claim 12 wherein said inner section is disposed coaxially within said outer section, said dispenser further including a first valve disposed within said inner section and said cylinder section is disposed between said outer and inner sections to mount said trigger structure on said base body.

14. The pump dispenser of claim 13 wherein said cylinder section and said vent cylinder section form part of said base body, said cylinder section is a first cylinder section and said base body includes a second cylinder section which mounts therein said second valve casing section, said dispenser further including a second valve disposed within said second valve casing section, and said trigger structure is disposed for reciprocating movement relative to said base body.

15. A spraying apparatus mounting thereon the pump dispenser of claim 12.

16. A manually operable pump dispenser for mounting on a vessel wherein liquid contained in a cylinder section is compressed with a piston section by displacement of a trigger structure and is ejected through a nozzle orifice, said dispenser comprising:

a base body for fixing on an orifice of the vessel by a packing structure;

a cylinder section and a vent cylinder section formed adjacent one another on said base body; and a trigger structure including a trigger section, a valve casing section mounted on said base body, and a trigger guide section disposed in said vent cylinder section, said valve casing section defining an outer boss section and an inner boss section between which said cylinder section is disposed, said inner and outer boss sections oscillating relative to said cylinder section and said trigger guide oscillating relative to said vent cylinder section during use of said dispenser.

17. The pump dispenser of claim 16 wherein said inner boss section is spaced coaxially inwardly from said outer boss section, and said dispenser further includes a valve and a piston section disposed within said inner boss section which cooperate with said cylinder section during use of said dispenser to pump liquid from the vessel through the nozzle orifice.

18. A manually operable pump dispenser for mounting on a vessel wherein liquid contained in a cylinder section is compressed with a piston section by displacement of a trigger structure and is ejected through a nozzle orifice, said dispenser comprising:

a base body for attachment to an orifice of the vessel by a packing structure;

a cylinder section and a vent cylinder section formed adjacent one another on said base body;

a trigger structure including a trigger section, a valve casing section mounted on said base body, and a trigger guide section which oscillates within said vent cylinder section; and a virgin seal section integrated with said vent cylinder section and disposed to prevent actuation of said trigger structure.

19. The pump dispenser of claim 18 wherein said virgin seal section includes a cylindrical portion which surrounds said trigger guide and is removably attached to an outer end of said vent cylinder section, and a handle which is pulled to detach said virgin seal section from said trigger guide and said vent cylinder section to permit actuation of said trigger structure.

20. A manually operable pump dispenser for mounting on a vessel wherein liquid contained in a cylinder section is compressed with a piston section by displacement of a trigger structure and is ejected through a nozzle orifice, said dispenser comprising:

a base body fixed on an orifice of the vessel by a packing structure;

a cylinder section and a vent cylinder section formed adjacent one another on said base body;

a trigger structure including a trigger section, a valve casing section mounted on said base body, and a trigger guide section which oscillates within said vent cylinder section, said valve casing section defining an outer boss section; and a trigger lock section integrated with said base body and connected thereto by a hinge, said trigger lock section being disposed in contacting engagement with a terminal end of said outer boss section of said valve casing section to prevent actuation of said trigger structure.

21. The pump dispenser of claim 20 wherein said valve casing section includes an inner boss section spaced coaxially inwardly from said outer boss section and said cylinder section is disposed between said inner and outer boss sections to mount said trigger structure on said base body, said trigger structure being reciprocatingly movable relative to said base body during use of said dispenser, and said trigger lock section being disposed in abutting engagement with said terminal end of said outer boss section to prevent rearward movement of said trigger structure relative to said base body.

22. The pump dispenser of claim 21 wherein said hinge permits swinging movement of said trigger lock section relative to said base body between a blocking position wherein said trigger lock section is disposed in contacting engagement with said terminal end of said outer boss section and a use position wherein said trigger lock is out of contacting engagement with said terminal end and seated within a recess defined in said base body rearwardly of said outer boss section.

23. A manually operable pump dispenser for mounting on a vessel wherein liquid contained in a cylinder section is compressed with a piston section by displacement of a trigger structure and is ejected through a nozzle orifice, said dispenser comprising:

a base body fixed on an orifice of the vessel by a packing structure;

a cylinder section and a vent cylinder section formed adjacent one another on said base body;

a trigger structure including a trigger section, a valve casing section mounted on said base body, and a trigger guide section which oscillates within said vent cylinder section; and a piston section disposed within said valve casing section, said piston section including a cylindrical body having a terminal end mounting a virgin seal thereon, and said cylinder section defines a receptacle section for receiving said cylindrical body and an outwardly projecting shaft disposed within said receptacle section for displacing said virgin seal.

24. The pump dispenser of claim 23 wherein said valve casing section defines an outer boss-shaped section and an inner boss-shaped section disposed coaxially inwardly of said outer section, said piston section being disposed within said inner section and cooperating with a valve disposed therein, and said cylinder section being disposed between said inner and outer sections to mount said trigger structure on said base body.

25. The pump dispenser of claim 23 wherein said virgin seal is initially mounted on said terminal end by a thin section of material which is severed by said shaft upon actuation of said trigger structure, said thin section defining a hinge which permanently connects said virgin seal to said terminal end and allows said virgin seal to swing inwardly into said terminal end upon actuation of said trigger structure.

* * * * *